US009470387B2

(12) United States Patent
Yokoi et al.

(10) Patent No.: US 9,470,387 B2
(45) Date of Patent: Oct. 18, 2016

(54) VEHICULAR HEADLAMP

(71) Applicant: KOITO MANUFACTURING CO., LTD., Tokyo (JP)

(72) Inventors: Shoichiro Yokoi, Shizuoka (JP); Satoru Mikuni, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 140 days.

(21) Appl. No.: 14/031,480

(22) Filed: Sep. 19, 2013

(65) Prior Publication Data

US 2014/0092617 A1 Apr. 3, 2014

(30) Foreign Application Priority Data

Oct. 1, 2012 (JP) ..... 2012-219513

(51) Int. Cl.
*F21V 19/02* (2006.01)
*F21S 8/10* (2006.01)

(52) U.S. Cl.
CPC ..... *F21S 48/1794* (2013.01); *F21S 48/1778* (2013.01)

(58) Field of Classification Search
CPC ..... F21S 48/1794; F21S 48/1778
USPC ..... 362/509, 512, 523
See application file for complete search history.

(56) References Cited

U.S. PATENT DOCUMENTS

2012/0113662 A1* 5/2012 Shibata ..... F21S 48/1773 362/512

FOREIGN PATENT DOCUMENTS

JP 2007213938 8/2007

* cited by examiner

*Primary Examiner* — Andrew Coughlin
*Assistant Examiner* — Meghan Ulanday
(74) *Attorney, Agent, or Firm* — Abelman, Frayne & Schwab

(57) ABSTRACT

Provided is a vehicular headlamp including a lamp casing configured by a lamp housing having an opening at least at one side thereof and a cover that covers the opening of the lamp housing, and a lamp unit disposed within the lamp casing. The lamp unit includes: a light source unit having a light source; a movable shade configured to be rotatable and change the shielding quantity of light; a solenoid having an output shaft which moves in a left-and-right direction and configured to rotate the movable shade; a rotation shaft configured to function as a rotation fulcrum of the movable shade, the axial direction of the shaft corresponding to the left and right direction; and an orthogonal transformation mechanism configured to convert a movement action of the output shaft to a rotation movement of the movable shade.

5 Claims, 9 Drawing Sheets

VEHICULAR HEADLAMP

CROSS-REFERENCE TO RELATED APPLICATIONS

This application is based on and claims priority from Japanese Patent Application No. 2012-219513 filed on Oct. 1, 2012 with the Japan Patent Office and the disclosure of which is incorporated herein in its entirety by reference.

TECHNICAL FIELD

The present disclosure relates to a vehicular headlamp. Specifically, the present disclosure relates to a technology in which at least a portion of a rotation shaft is disposed at an upper side of a solenoid, thereby reducing the size of the vehicular headlamp in the front and rear direction.

BACKGROUND

A vehicular headlamp known in the art is provided with a lamp unit which includes, for example, a light source disposed within a lamp casing configured by, for example, a cover and a lamp housing.

In the lamp unit of the vehicular headlamp, a light quantity control mechanism configured to control a light quantity emitted from the light source is provided and the light quantity control mechanism includes a movable shade configured to change the shielding quantity of the light emitted from the light source and a solenoid configured to operate the movable shade. See, e.g., FIG. 4 of Japanese Patent Laid-Open Publication No. 2007-213938.

In the vehicular headlamp disclosed in Japanese Patent Laid-Open Publication No. 2007-213938, an output shaft of the solenoid disposed in front of the solenoid and the movable shade disposed behind the solenoid are connected with each other by a wire type arm and the movable shade is configured to be rotatable on a rotation shaft extending to the left and the right as a fulcrum. When the output shaft of the solenoid moves in the left and right direction, the arm is rotated and the movable shade turns on the rotation shaft as a fulcrum with the rotation of the arm.

When the movable shade turns to a first position, the irradiation mode is switched into a low beam irradiation mode that irradiates a short distance. When the movable shade turns to a second position, the irradiation mode is switched into a high beam irradiation mode that irradiates a long distance.

In the vehicular headlamp disclosed in Japanese Patent Laid-Open Publication No. 2007-213938, the output shaft of the solenoid is disposed to be movable in the left and right direction and the rotation shaft of the movable shade is also disposed such that the axial direction of the rotation shaft corresponds to the left and right direction. Thus, the size of the vehicular headlamp may be reduced in the front and rear direction.

SUMMARY

In the vehicular headlamp disclosed in Japanese Patent Laid-Open Publication No. 2007-213938, since the solenoid and the movable shade are connected with each other by the arm, and the solenoid and the movable shade are positioned to be spaced apart from each other in the front and rear direction, a solenoid disposition space and a movable shade disposition are individually required in the front and rear direction. Therefore, it is difficult to say that the size in the front and rear direction is sufficiently reduced.

Thus, an aspect of the present disclosure is to provide a vehicular headlamp which may overcome the above-described problem so as to reduce the size in the front and rear direction.

According to an aspect of the present disclosure, provided is a vehicular headlamp including a lamp unit disposed within a lamp casing that is configured by a lamp housing having an opening at least at one side thereof and a cover that covers the opening of the lamp housing. The lamp unit includes: a light source unit having a light source; a movable shade configured to be rotatable and change the shielding quantity of light projected from the light source; a solenoid having an output shaft which moves in a left and right direction and configured to rotate the movable shade; a rotation shaft configured to function as a rotation fulcrum of the movable shade, the axial direction of the shaft corresponding to the left and right direction; and an orthogonal transformation mechanism configured to convert a movement action of the output shaft to a rotation action of the movable shade. At least a portion of the rotation shaft is positioned above the solenoid.

Therefore, in the vehicular headlamp, a space for disposing at least a portion of the rotation shaft and a space for disposing the solenoid are positioned vertically.

The vehicular headlamp of the present disclosure includes a lamp casing configured by a lamp housing having an opening at least at one side and a cover that covers the opening of the lamp housing, and a lamp unit disposed within the lamp casing. The lamp unit includes: a light source unit having a light source; a movable shade configured to be rotatable and change the shielding quantity of light emitted from the light source; a solenoid having an output shaft which moves in a left and right direction and configured to rotate the movable shade; a rotation shaft configured to function as a rotation fulcrum of the movable shade, the axial direction of the shaft corresponding to the left and right direction; and an orthogonal transformation mechanism configured to convert a movement action of the output shaft to a rotation action of the movable shade. At least a portion of the rotation shaft is positioned above the solenoid.

Therefore, since the rotation shaft and the output shaft are disposed in a direction extending in the left and right direction and then the rotation shaft is positioned above the solenoid, it is not required to provide a space for disposing the solenoid and a space for disposing the movable shade separately in the front and rear direction. As a result, the size in the front and rear direction may be sufficiently reduced.

According to an exemplary embodiment, the vehicular headlamp further includes a support plate configured to support the rotation shaft, in which the solenoid is provided with a yoke case, and the support plate is attached to the yoke case.

Therefore, a dedicated member such as, for example, a bracket configured to attach the support plate becomes unnecessary. Thus, the manufacturing costs may be reduced by reducing the number of components and simplifying the mechanism.

According to another exemplary embodiment, the vehicular headlamp further includes a support plate configured to support the rotation shaft, in which the solenoid is provided with a yoke case, and the support plate is integrally formed with the yoke case.

Therefore, a process of attaching the support plate to the yoke case becomes unnecessary and the number of components and the manufacturing costs may be reduced.

According to still another exemplary embodiment, the orthogonal transformation mechanism includes: a rotation link which is rotated by the movement of the output shaft; a first connecting pin configured to connect the output shaft and the rotation link; and a second connecting pin configured to connect the movable shade and the rotation link. The first connecting pin is inserted into the output shaft and the rotation link so that the output shaft and the rotation link are connected with each other and the second connecting pin is inserted into the movable shade and the rotation link so that the movable shade and the rotation link are connected with each other.

Therefore, a process of connecting the rotation link with the output shaft and the movable shade may be facilitated and the workability may be improved.

According to yet another exemplary embodiment, within a rotation range of the rotation link, the second connecting pin is positioned between a rotation fulcrum of the rotation link and the first connecting pin.

Therefore, the rotation space of the rotation link may be formed in a small size and thus, size in the front and rear direction may be reduced.

According to yet another exemplary embodiment, the top surface portion and the bottom surface portion of the yoke case are provided as attachment surface portions, respectively, to which the support plate is selectively attached.

Therefore, the support plate may be selectively attached to the top surface and the bottom surface for use in the left vehicular lamp and the right vehicular lamp of the right side so as to use the same solenoid. As a result, the number of components and the manufacturing costs may be reduced due to the improvement of versatility.

The above-described summary is illustration purposes only and does not intend to limit in any ways. In addition to the illustrative embodiment, examples, and features described above, additional embodiment, example, and features will become apparent by referring to the drawings and the following detailed description.

DETAILED DESCRIPTION

In the following detailed description, reference is made to the accompanying drawings which form a part hereof. The illustrative embodiments described in the detailed descriptions, drawings, and claims do not intend to limit. Other embodiments may be utilized and other modified examples may be made without departing from the spirit or scope of the subject matter presented here.

Hereafter, detailed description for an exemplary embodiment of a vehicular headlamp according to the present disclosure will be described with reference to drawings.

Each vehicular headlamp 1 is disposed at and attached to one of left and right ends of the front end of a vehicle.

Figure 1:
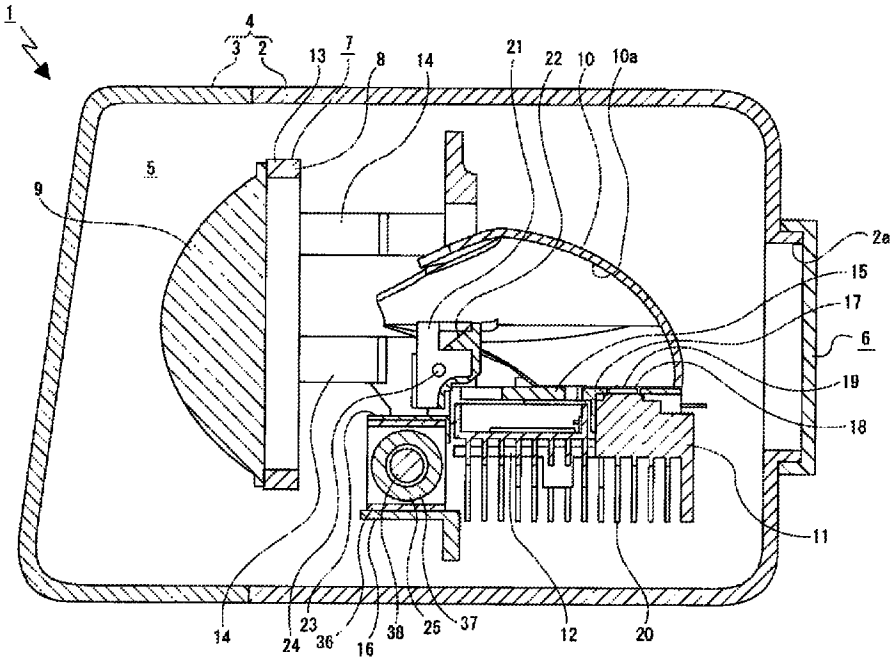
FIG. 1 is a longitudinal sectional view schematically illustrating an exemplary embodiment of a vehicular headlamp of the present disclosure.

The vehicular headlamp 1 includes a lamp housing 2 having an opened concave portion at the front side and a cover 3 that covers the opening of the lamp housing 2 (see, e.g., FIG. 1). A lamp casing 4 is configured by the lamp housing 2 and the cover 3, and the inner space of the lamp casing 4 is formed as a lamp chamber 5.

At the rear end of the lamp housing 2, an attachment hole 2*a* penetrated in the front and rear direction is formed. A back cover 6 is attached to the attachment hole 2*a*.

A lamp unit 7 is disposed within the lamp chamber 5. The lamp unit 7 includes a lens holder 8, a projection lens 9 attached to the front end of the lens holder 8, a reflector 10 configured to reflect light, a light source unit 11 disposed under the reflector 10, and a cooling fan 12 attached to the bottom surface of the light source unit 11.

The lens holder 8 includes a lens attachment portion 13 which is substantially in an annular shape and penetrated in the front and rear direction, lateral portions 14, 14, . . . protruding rearward from the left and right ends of the lens attachment portion 13, respectively, and a holding unit 15 provided between the lateral portions 14, 14, . . . disposed at the left and right sides.

The lateral portions 14, 14, . . . are each formed in a plate shape facing substantially in the left and right direction.

The holding unit 15 includes a solenoid attachment portion 16 disposed at the front side and an attachment surface portion 17 disposed at the rear side of the solenoid attachment portion 16.

The projection lens 9 is formed in a substantially hemisphere shape and attached to the lens attachment portion 13 of the lens holder 8.

The inner surface of the reflector 10 is formed as a reflecting surface 10*a*. The reflector 10 is attached to the top surface of the light source unit 11.

The light source unit 11 includes a circuit board 18 and a light source 19 mounted on the top surface of the circuit board 18. As the light source 19, for example, a light emitting diode (LED) is used. The light source unit 11 is provided with a heat sink 20 disposed below the circuit board 18. A cooling fan 12 is disposed inside of the heat sink 20.

The light source unit 11 is attached to the attachment surface portion 17 of the lens holder 8.

A light quantity control mechanism 21 is attached to the lens holder 8.

Figure 2:
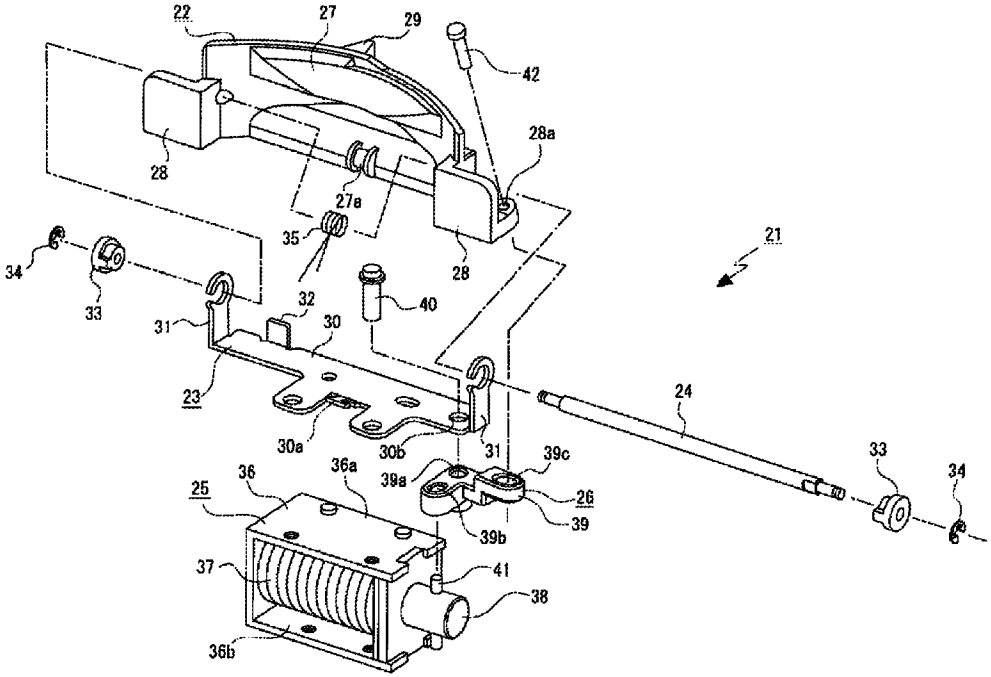
FIG. 2 is an exploded perspective view of a light quantity control mechanism.
Figure 3:
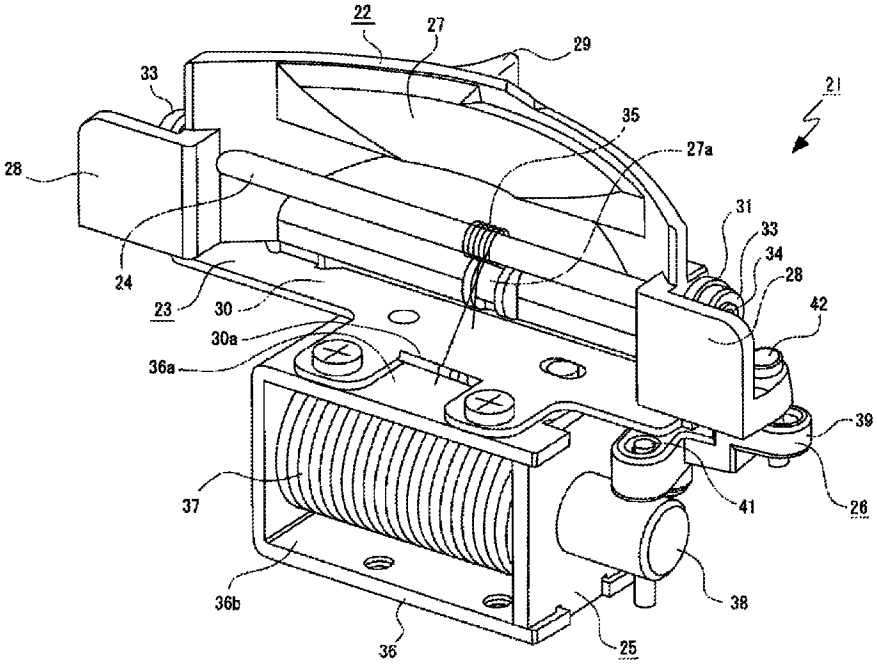
FIG. 3 is a perspective view illustrating a state in which a movable shade is maintained at a first position.

The light quantity control mechanism 21 includes a movable shade 22, a support plate 23, a rotation shaft 24, a solenoid 25, and an orthogonal transformation mechanism 26 (see, e.g., FIGS. 2 and 3).

The movable shade 22 includes a light quantity control portion 27 which is formed in a substantially circular arc surface shape, protrusions 28, 28 protruding from the left and right ends of the light quantity control portion 27 to the outer sides (lateral sides), respectively, and a stopper portion 29 protruding rearward from the light quantity control portion 27. At the front surface side of the lower end portion of the light quantity control portion 27, a spring tray portion 27*a* is formed. One of the protrusions 28 is formed with a shaft insertion hole 28*a* which is substantially vertically penetrated.

Figure 4:
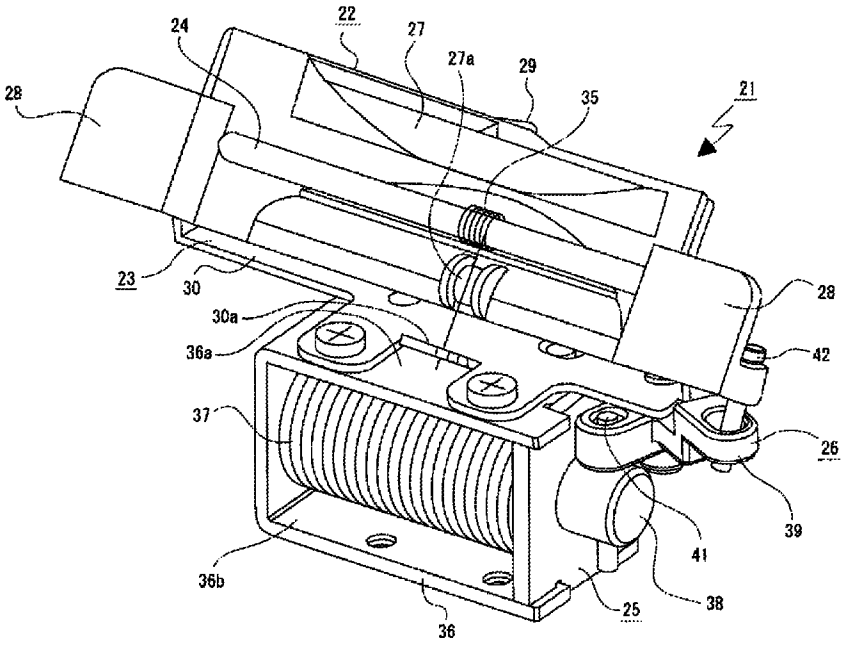
FIG. 4 is a perspective view illustrating a state in which a movable shade is maintained at a second position.

The movable shade 22 is rotated on the rotation shaft 24 as a fulcrum between a first position (see, e.g., FIG. 3) where a part of the light emitted from the light source 19 is shielded and a second position where the shielding quantity becomes less than that of the first position (see, e.g., FIG. 4). The first position is a low beam position where a short distance is irradiated and the light quantity control portion 27 of the movable shade 22 is in a substantially vertical state. The second position is a high beam position where a long distance is irradiated and the light quantity control portion 27 of the movable shade 22 is in a tilted state.

The support plate 23 includes a base surface portion 30 facing the up and down direction, shaft support protrusions 31, 31 protruding upward from the left and right ends of the base surface portion 30, respectively, and a stopper protrusion 32 protruding from the rear end of the base surface portion 30 upward (see, e.g., FIG. 2).

A spring hook portion 30*a* protruding forward and slanting upward is provided at the front end of the base surface portion 30. The base surface portion 30 is formed with a shaft insertion hole 30*b* at one end in the left and right direction thereof.

The axial direction of the rotation shaft 24 corresponds to the left and right direction and the axial opposite ends of the rotation shaft 24 are inserted through the movable shade 22 in the vicinity of the left and right ends of the movable shade 22. The axial opposite ends of the rotation shaft 24 are positioned at lateral sides (outsides) of the light quantity control portion 27 and the portion other than the opposite ends of the rotation shafts is positioned in front of the light quantity control portion 27. Fixation rivets 33, 33 and fixation rings 34, 34 are fixed to the axial opposite ends of the rotation shaft 24, respectively, and the rotation shaft 24 is fixed to the movable shade 22. Therefore, the movable shade 22 is rotated on the rotation shaft 24 as a fulcrum integrally with the rotation shaft 24.

The portion of the rotation shafts 24 positioned in front of the light quantity control portion 27 is rotatably supported by the shaft support protrusions 31, 31 of the support plate 23. A compression spring 35 which is a torsional coil spring is fit on and supported by the rotation shaft 24 and both ends of the compression spring 35 are engaged with the spring abutments 27*a* of the movable shade 22 and the spring hook portion 30*a* of the support plate 23, respectively. Therefore, the movable shade 22 is urged to the direction in which the movable shade 22 is rotated from the second position to the first position by the compression spring 35.

The solenoid 25 includes a yoke case 36, a coil body 37 disposed within the yoke case 36, and an output shaft 38 movable in the left and right direction.

The yoke case 36 is formed in a frame shape which is penetrated in a rectangular shape in the front and rear direction.

The axial direction of the coil body 37 corresponds to the left and right direction, and the axial direction of the output shaft 38 corresponds to the left and right direction so that a portion of the output shaft 38 protrudes laterally from the yoke case 36.

The base surface portion 30 of the support plate 23 is attached to the top surface portion 36*a* of the yoke case 36 by, for example, screw fixation. In a state in which the base surface portion 30 is attached to the top surface portion 36*a*, the left and right ends of the base surface portion 30 protrude from the yoke case 36 laterally, respectively. Also, in a state in which the base surface portion 30 is attached to the top surface portion 36*a*, the rotation shaft 24 and the movable shade 22 are positioned above the solenoid 25.

The orthogonal transformation mechanism 26 includes a rotation link 39, a fulcrum shaft 40 which functions as a rotation fulcrum of the rotation link 39, a first connecting pin 41, and a second connecting pin 42 in which the first and second connecting pins 41, 42 are inserted into the rotation link 39, respectively.

The rotation link 39 is formed in a substantially L shape when viewed from the top. A hole to be supported 39*a* which is vertically penetrated is formed at a curved middle portion, and first and second connecting holes 39*b*, 39*c* which are vertically penetrated are formed at both ends, respectively. The first connecting hole 39*b* is formed in a slot shape which extends substantially to the front and the rear and the second connecting hole 39*b* is formed in a slot shape which extends substantially to the left and the right.

The fulcrum shaft 40 is sequentially inserted to the shaft insertion hole 30*b* of the support plate 23 and the hole to be supported 39*a* of the rotation link 39 from the upper side. Therefore, the rotation link 39 is rotated horizontally on the fulcrum shaft 40 as the fulcrum in relation to the support plate 23.

The first connecting pin 41 is inserted into the first connecting hole 39*b* of the rotation link 39 and inserted through and fixed to the output shaft 38 of the solenoid 25. Therefore, the output shaft 38 and the rotation link 39 are connected with each other by the first connecting pin 41. The first connecting pin 41 is adapted to be able to move in the first connecting hole 39*b* along the longitudinal direction (substantially in the front and rear direction) of the first connecting hole 39*b* when the rotation link 39 is rotated.

The second connecting pin 42 is sequentially inserted into the shaft insertion hole 28*a* of the movable shade 22 and the second connecting hole 39*c* of the rotation link 39 from the upper side. Therefore, the movable shade 22 and the rotation link 39 are connected with each other by the second connecting pin 42. The second connecting pin 42 is adapted to be able to move in the second connecting hole 39*c* along the longitudinal direction (substantially in the left and right direction) of the second connecting hole 39*c* when the rotation link 39 is rotated.

The lamp unit 7 is supported to the housing 2 to be capable of being tilted through an aiming adjustment mechanism (not illustrated). Therefore, by the operation of the aiming adjustment mechanism, the lamp unit 7 is tilted in the up and down direction or in the left and right direction so that optical axis adjustment (initial adjustment) of the light source 19 is performed.

Also, for example, the lamp unit 7 may be supported by the lamp housing 2 to be capable of being tilted in the up and down direction. When the lamp unit 7 is supported by the lamp housing 2 to be capable of being tilted in the up and down direction, a leveling adjustment mechanism (not illustrated) is connected to the lamp unit 7 so that the lamp unit 7 is tilted in the up and down direction by the operation of the leveling adjustment mechanism, and the optical axis direction of the light source 19 is adjusted according to the weight of goods loaded on the vehicle.

Further, the lamp unit 7 may be rotated, for example, in the horizontal direction. When the lamp unit 7 is adapted to be capable of being rotated in the horizontal direction, a swivel mechanism (not illustrated) is connected to the lamp unit 7 so that the lamp unit 7 is rotated in the horizontal direction by the operation of the swivel mechanism and the optical axis is changed according to the driving direction of the vehicle.

In the vehicular headlamp 1 configured as described above, in a state in which a driving current is not supplied to the coil body 37 of the solenoid 25, the protrusions 28, 28 of the movable shade 22 urged by the biasing spring 35 are urged against the base surface portion 30 of the support plates 23 and maintained at the first position (see, e.g., FIG. 3). At this time, the output shaft 38 of the solenoid 25 is positioned at a moving end in the protruding direction from the yoke case 36.

In the state in which the movable shade 22 is at the first position, when light is emitted from the light source 19, a part of the light is shielded by the movable shade 22. The non-shielded light is incident on the projection lens 9 and projected by the projection lens 9. As a result, a low beam light distribution pattern irradiating a short distance is formed.

When the electricity is supplied to the coil body 37 of the solenoid 25, the output shaft 38 moves in the direction drawn into the yoke case 36 and the rotation link 29 is rotated on the fulcrum shaft 40 as the fulcrum (see, e.g., FIG. 4). When the rotation link 39 is rotated, the position of the second connecting pin 42 is changed and the movable shade 22 is rotated on the rotation shaft 24 as the fulcrum from the first position to the second position against the biasing force of the biasing spring 35. The stopper portion 29 of the movable shade 22 is in contact with the stopper protrusion 32 of the support plate 23, thereby maintaining the movable shade 22 at the second position.

When the movable shade 22 is rotated up to the second position, the shielding quantity of the light emitted from the light source 19 is reduced and the high beam light distribution pattern irradiating the long distance is formed.

When the electricity supply to the coil body 37 is stopped, the movable shade 22 is rotated on the rotation shaft 24 as the fulcrum from the second position up to the first position by the biasing force of the biasing spring 35. According to the rotation of the movable shade 22, the rotation link 39 is rotated and the output shaft 38 is moved to the moving end in the direction protruding from the yoke case 36 (see, e.g., FIG. 3).

Figure 5:
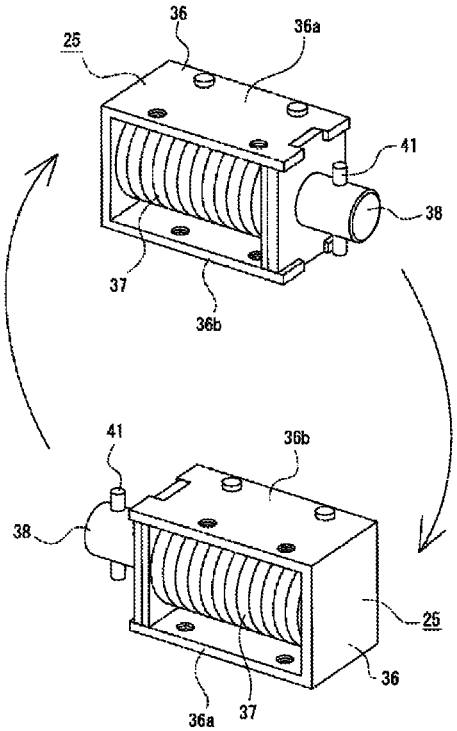
FIG. 5 is a perspective view illustrating an example in which a solenoid is reversely used.

Also, the solenoid 25 is provided with a connection portion (not illustrated) where a cable for the electricity supply is connected in which the cable connection portion is provided at the opposite side to the side protruding from the yoke case 36 of the output shaft 38 in the left and right direction. Therefore, by providing both the top surface portion 36*a* and the bottom surface portion 36*b* of the yoke case 36 as the attachment surface portions, as illustrated in FIG. 5, the solenoid 25 may be turned upside down so that the capable connection portion may be positioned at the inner side or the outer side together in the left and right direction for use in the vehicular headlamp 1 of left side and the vehicular headlamp 1 of the right side.

As described above, by providing both the top surface portion 36*a* and the bottom surface portion 36*b* of the yoke case 36 as the attachment surface portions of the support plates 23, the support plate 23 may be selectively attached to the top surface portion 36*a* and the bottom surface portion 36*b* and the same solenoid 25 may be used. Therefore, the number of components and the manufacturing costs may be reduced due to the improvement of versatility.

Figure 6:
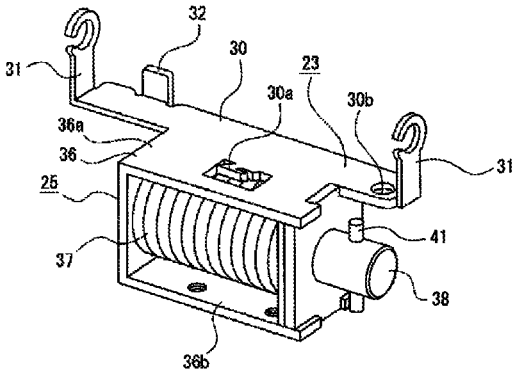
FIG. 6 is a perspective view illustrating an example in which a support plate is integrally formed in a yoke case.

Also, in the above description, an example in which the support plate 23 is attached to the yoke case 36 of the solenoid 25 has been described. However, the yoke case 36 and the support plate 23 may be integrally formed (see, e.g., FIG. 6). When the yoke case 36 and the support plate 23 are integrally formed, a process of attaching the support plate to the yoke case 36 becomes unnecessary and the number of the components and the manufacturing costs may be reduced.

Figure 7:
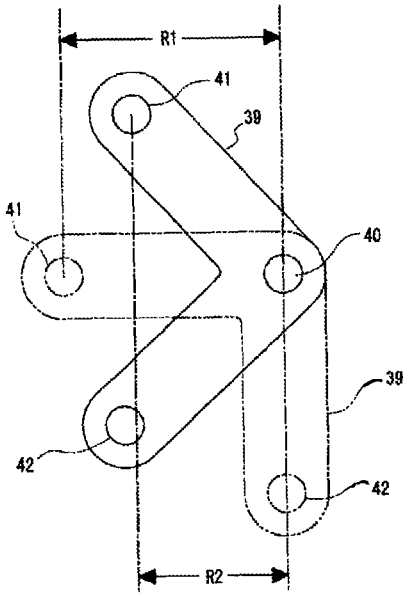
FIG. 7 is an enlarged schematic plan view illustrating a positional relationship of a fulcrum shaft and each connecting pin within a rotation range of a rotation link.

Further, in the light quantity control mechanism 21, with respect to the fulcrum shaft 40 and the first and second connecting pins 41, 42 which are individually inserted into the rotation link 38, the second connecting pin 42 is positioned between the fulcrum shaft 40 and the first connecting pin 41 in the front-rear direction in the rotation ranges R1, R2 of the rotation link 39 (see, e.g., FIG. 7).

Therefore, the rotation space of the rotation link 39 is reduced and thus, the vehicular headlamp 1 may be reduced in size in the front and rear direction of the vehicular headlamp 1.

Moreover, in the light quantity control mechanism 21, the first connecting pin 41 is inserted into the output shaft 38 and the rotation link 39 so that the output shaft 38 and the rotation link 39 are connected with each other and the second connecting pin 42 is inserted into the movable shade 22 and the rotation link 39 so that the movable shade 22 and the rotation link 39 are connected with each other.

Therefore, the process of connecting the rotation link 39 and the output shaft 38 and the movable shade 22 may be facilitated and the workability may be improved.

Hereinafter, a modified example of the lens holder and the light quantity control mechanism will be described (see, e.g., FIGS. 8 and 9).

A light quantity control mechanism 51 according to the modified example is attached to the lens holder 8.

The light quantity control mechanism 51 includes a movable shade 52, a support plate 53, a rotation shaft 54, a solenoid 55, and an orthogonal transformation mechanism 56.

The movable shade 52 includes a light quantity control portion 57 which is formed in a substantially circular arc surface shape, protrusions 58, 58 protruding from the left and right ends of the light quantity control portion 57 outward (laterally) respectively, and a stopper portion 59 protruding rearward from the light quantity control portion 57.

The movable shade 52 is rotated on the rotation shaft 54 as a fulcrum between a first position where a part of the light emitted from the light source 19 is shielded and a second position where the shielding quantity becomes less than that of the first position. The first position is a low beam position of where a short distance is irradiated and the light quantity control portion 57 of the movable shade 52 becomes a substantially vertical state. The second position is a high beam position where a long distance is irradiated and the light quantity control portion 57 of the movable shade 52 becomes a tilted state.

The support plate 53 includes a base surface portion 60 facing the front and rear direction and shaft support protrusions 61, 61 protruding upward from the left and right ends of the base surface portion 60, respectively.

The base surface portion 60 is provided with a spring hook portion 60*a* which protrudes forward.

The rotation shaft 54 has an axial direction which corresponds to the left and right direction and penetrates the movable shade 22 at positions in the vicinity of the left and right ends of the movable shade 22, respectively. The axial opposite ends of the rotation shaft 54 are positioned at lateral sides of the movable shade 52 and the portion in the shaft direction other than the both ends is positioned in front of the light quantity control portion 57 of the movable shade 52. At a location in the vicinity of one of the axial ends of the rotation shaft 54, a connecting base 62 is fixed. The connecting base 62 is provided as a connecting portion 62*a* of which the rear end is positioned behind the rotation shaft 54. At the opposite ends of the shaft direction of the rotation shaft 54, fixation rivets 63, 63 and fixation rings 64, 64 are attached, respectively so that the rotation shaft 54 is fixed to the movable shade 52. Therefore, the movable shade 52 is rotated integrally with the rotation shaft 54 on the rotation shaft 54 as a fulcrum.

The portion of the rotation shaft 54 positioned in front of the light quantity control portion 57 is rotatably supported by the shaft support protrusions 61, 61 of the support plate 53. A biasing spring 65 which is a twist coil spring is externally put on the rotation shaft 54 and supported and both ends of the biasing spring 65 are engaged with the spring abutment 57*a* of the movable shade 52 and the spring hook portion 60*a* of the support plate 53. Therefore, the movable shade 52 is urged to the direction of rotating the movable shade 52 from the second position to the first position by the biasing spring 65.

The solenoid 55 includes a yoke case 66, a coil body 67 disposed within the yoke case 66, and an output shaft 68 movable in the left and right direction.

The yoke case 66 is formed in a frame shape which is penetrated in a rectangular shape in the front and rear direction.

The axial direction of the coil body 67 corresponds to the left and right direction. The output shaft 68 has an axial direction in the left and right direction and partially protrudes laterally from the yoke case 66. At the protruding portion from the yoke case 66 of the output shaft 68, a connecting neck portion 68*a* of which the diameter is narrower than that of other portion is formed.

A portion of the upper end of the front surface portion 66*a* of the yoke case 66 protrudes laterally.

A base surface portion 60 of the support plate 53 is attached to the upper end of the rear surface portion 66*b* of the yoke case 66 by, for example, screw fixation. In the state in which the base surface portion 60 is attached to the rear surface portion 66*b*, the left and right ends of the base surface portion 60 protrude from the yoke case 66 laterally. Also, in the state in which the base surface portion 60 is attached to the rear surface portion 66*b*, the rotation shaft 54 and the movable shade 52 are positioned at the upper side of the solenoid 55.

The orthogonal transformation mechanism 56 includes a rotation link 69, a fulcrum shaft 70 that functions as a rotation fulcrum, a pressing member 71 configured to press the fulcrum shaft 70, and a wire type connecting member 72.

The rotation link 69 is formed with a flat supported portion 73 facing the front and rear direction, a connecting plate portion 74 protruding substantially downwards from the flat supported portion 73, and an arm portion 75 protruding rearward from the flat supported portion 73. The flat supported portion 73 is formed with a supported hole 73*a* and the rear end of the arm portion 75 is provided as a connecting portion 75*a*.

The fulcrum shaft 70 is attached to a portion protruding laterally of the front surface portion 66*a* of the yoke case 66 and provided to protrude rearward.

The fulcrum shaft 70 is inserted into the supported hole 73*a* of the rotation link 69 and the rotation link is rotatably supported by the fulcrum shaft 70. In the state in which the rotation link 69 is supported by the fulcrum shaft 70, the pressing member 71 is attached to the fulcrum shaft 70 and the rotation link 69 is pressed by the pressing member 71 so that the rotation link 62 is suppressed from releasing from the fulcrum shaft 70.

In the state in which the rotation link 69 is supported by the fulcrum shaft 70, the connecting plate portion 74 is fit on the connecting neck portion 68*a* formed on the output shaft 68 of the solenoid 55 so that the rotation link 69 is connected to the output shaft 68.

The connecting member 72 is connected to the connecting portion 75*a* provided for the arm portion 75 of the rotation link 69 at one end and connected to the connecting portion 62*a* of the connecting base 62 at the other end. Therefore, the rotation link 69 connected to the output shaft 68 and the connecting base 62 fixed at the rotation shaft 54 are connected with each other via the connecting member 72.

In the vehicular headlamp 1 configured as described above, in a state in which a driving current is not supplied to the coil body 67 of the solenoid 55, the movable shade 52 urged by the biasing spring 65 is maintained at the first position. At this time, the output shaft 68 of the solenoid 55 is positioned at a moving end in the protruding direction from the yoke case 66.

In the state in which the movable shade 52 is at the first position, when light is emitted from the light source 19, a part of the light is shielded by the movable shade 52. The non-shielded light is incident on the projection lens 9 and the light is projected by the projection lens 9. As a result, a low beam light distribution pattern irradiating a short distance is formed.

Figure 8:
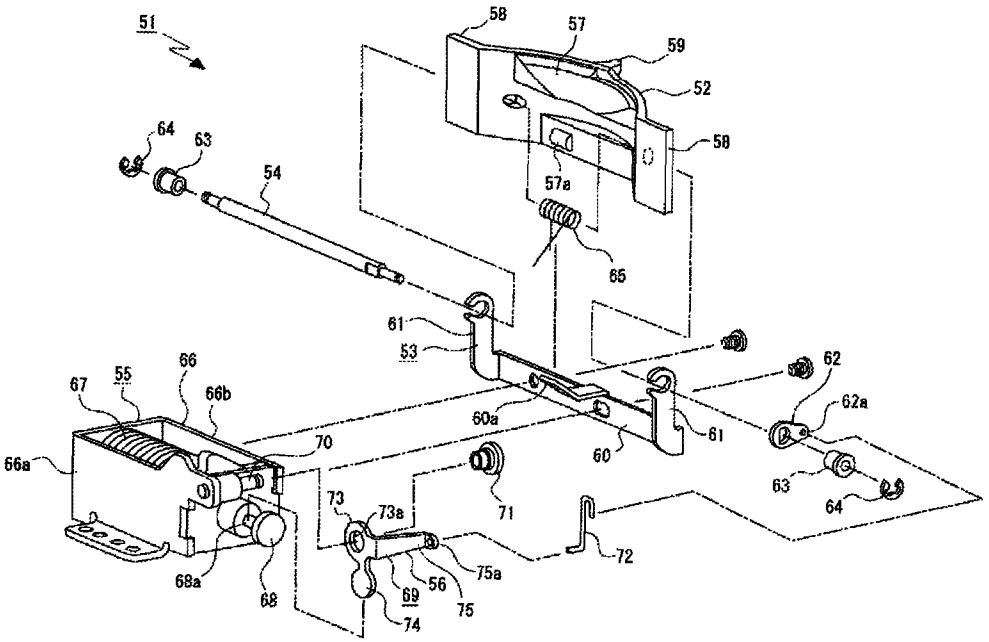
FIG. 8 is an exploded perspective view of a light quantity control mechanism according to a modified example.
Figure 9:
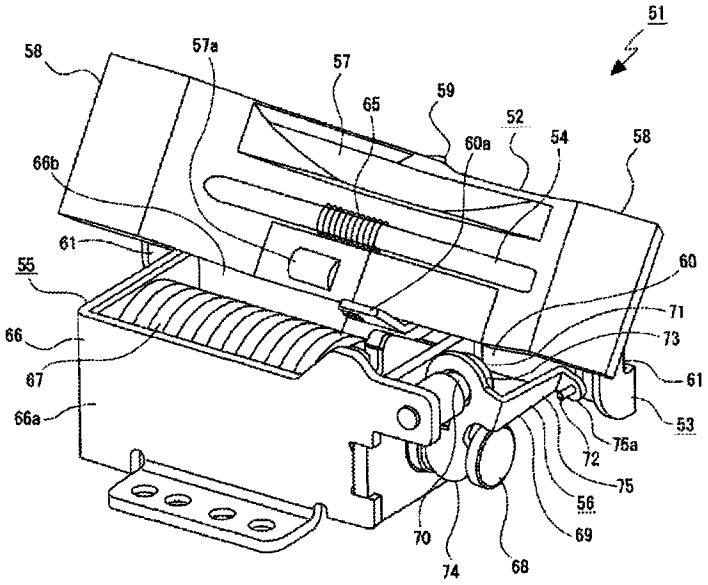
FIG. 9 is a perspective view illustrating a state in which a movable shade of a light quantity control mechanism according to the modified example is maintained at a second position.

When the electricity is supplied to the coil body 67 of the solenoid 55, the output shaft 68 moves in the direction drawn into the yoke case 66 and the rotation link 69 is rotated on the fulcrum shaft 40 as a fulcrum (see, e.g., FIG. 8). When the rotation link 69 is rotated, the connecting member 72 is moved downwards, the movable shade 52 is rotated on the rotation shaft 24 as the fulcrum from the first position to the second position against the biasing force of the biasing spring 65. The stopper portion 59 of the movable shade 52 is in contact with a stopper portion (not illustrated), thereby maintaining the movable shade 52 at the second position.

When the movable shade 52 is rotated up to the second position, the shielding quantity of the light emitted from the light source 19 is reduced and the high beam light distribution pattern irradiating the long distance is formed.

When the electricity supply to the coil body 67 is stopped, the movable shade 52 is rotated on the rotation shaft 54 as a fulcrum from the second position to the first position by the biasing force of the biasing spring 65. According to the rotation of the movable shade 52, the rotation link 69 is turned as the movable shade 52 is rotated and the output shaft 68 is moved to the moving end in the direction protruding from the yoke case 66.

As described above, in the vehicular headlamp 1, since the rotation shafts 24, 54 are disposed at the upper side of the solenoids 25, 55 after the rotation shafts 24, 54 and the output shafts 38, 68 are disposed in the direction extending in the left and right direction, it is not required to separately provide the spaces for disposing the solenoids 25, 55 and the movable shades 22, 52 in the front and rear direction. Therefore, the size in the front and rear direction may be sufficiently reduced.

Also, since the support plates 23, 53 are attached to the yoke cases 36, 66, a dedicated member such as, for example, a bracket becomes unnecessary. Therefore, the manufacturing costs may be reduced due to the reduction of the number of the components and the simplification of the mechanism.

Further, in the light quantity control mechanism 51 according to the modified example, the yoke case 66 and the support plate 53 may be integrally formed as in the light quantity control mechanism 21. When the yoke case 66 and the support plate 53 are integrally formed, a process of attaching the support plate 53 to the yoke case 66 becomes unnecessary and the number of components and the manufacturing costs may also be reduced.

In the above description, a vehicular lamp 1 having reflector 10 has been described as an example. However, the present disclosure may also be applied to a so-called direct projection type vehicular headlamp which does not have a reflector.

From the foregoing, it will be appreciated that various embodiments of the present disclosure have been described herein for purposes of illustration, and that various modifications may be made without departing from the scope and spirit of the present disclosure. Accordingly, the various embodiments disclosed herein are not intended to be limiting, with the true scope and spirit being indicated by the following claims.

What is claimed is:

1. A vehicular headlamp comprising:

a lamp casing configured by a lamp housing having an opening at least at one side thereof and a cover that covers the opening of the lamp housing; and a lamp unit disposed within the casing, wherein the lamp unit includes:

a light source unit which has a light source;

a movable shade configured to be rotatable and change a shielding quantity of light emitted from the light source;

a solenoid having an output shaft moving in a left and right direction and configured to rotate the movable shade;

a rotation shaft configured to function as a rotation fulcrum of the movable shade, an axial direction of the rotation shaft corresponding to the left and right direction; and an orthogonal transformation mechanism configured to convert a movement action of the output shaft to a rotation action of the movable shade, at least a portion of the rotation shaft for the movable shade is positioned at an upper side of the solenoid, wherein the orthogonal transformation mechanism includes:

a rotation link which is rotated according to a movement of the output shaft;

a first connecting pin configured to connect the output shaft and the rotation link; and a second connecting pin configured to connect the movable shade and the rotation link, wherein the first connecting pin is inserted into the output shaft and the rotation link so that the output shaft and the rotation link are connected with each other, and the second connecting pin is inserted into the movable shade and the rotation link so that the movable shade and the rotation link are connected with each other.

2. The vehicular headlamp of claim 1, further comprising a support plate configured to support the rotation shaft, wherein the solenoid is provided with a yoke case, and the support plate is attached to the yoke case.

3. The vehicular headlamp of claim 2, wherein a top surface portion and a bottom surface portion of the yoke case are provided as attachment surface portions, respectively, to which the support plate is selectively attached.

4. The vehicular headlamp of claim 1, further comprising a support plate configured to support the rotation shaft, wherein the solenoid is provided with a yoke case, and the support plate is integrally formed with the yoke case.

5. The vehicular headlamp of claim 1, wherein, within a rotation range of the rotation link, the second connecting pin is positioned between a rotation fulcrum of the rotation link and the first connecting pin.

* * * * *